US010254013B2

(12) United States Patent
Xiang et al.

(10) Patent No.: US 10,254,013 B2
(45) Date of Patent: Apr. 9, 2019

(54) TWO-STAGE ROTARY COMPRESSOR AND REFRIGERATION CYCLE DEVICE HAVING SAME

(71) Applicant: GUANGDONG MEIZHI COMPRESSOR CO., LTD., Foshan (CN)

(72) Inventors: Weimin Xiang, Foshan (CN); Yongjun Fu, Foshan (CN); Liyu Zheng, Foshan (CN); Hong Guo, Foshan (CN)

(73) Assignee: GUANGDONG MEIZHI COMPRESSOR CO., LTD., Foshan (CN)

( * ) Notice: Subject to any disclaimer, the term of this patent is extended or adjusted under 35 U.S.C. 154(b) by 309 days.

(21) Appl. No.: 15/121,244

(22) PCT Filed: Mar. 3, 2014

(86) PCT No.: PCT/CN2014/072803

§ 371 (c)(1),
(2) Date: Nov. 15, 2016

(87) PCT Pub. No.: WO2015/131313

PCT Pub. Date: Sep. 11, 2015

(65) Prior Publication Data

US 2017/0108246 A1 Apr. 20, 2017

(51) Int. Cl.
*F25B 1/02* (2006.01)
*F04C 23/00* (2006.01)
(Continued)

(52) U.S. Cl.
CPC ..... *F25B 1/02* (2013.01); *F04B 25/005* (2013.01); *F04C 18/3564* (2013.01); *F04C 23/001* (2013.01); *F04C 23/008* (2013.01); *F04C 28/06* (2013.01)

(58) Field of Classification Search
CPC ..... F04B 25/005; F04C 18/3564; F25B 1/02
See application file for complete search history.

(56) References Cited

U.S. PATENT DOCUMENTS 4,562,700 A 1/1986 Atsumi et al.
5,094,085 A 3/1992 Irino
(Continued)

FOREIGN PATENT DOCUMENTS

CN 1837619 9/2006
CN 202301036 7/2012
(Continued)

OTHER PUBLICATIONS

International Searching Authority, International Search Report for PCT/CN2014/072803 dated Dec. 9, 2014.
(Continued)

*Primary Examiner* — Filip Zec
(74) *Attorney, Agent, or Firm* — Hodgson Russ LLP

(57) ABSTRACT

A refrigeration cycle device and a two-stage rotary compressor thereof. The two-stage rotary compressor includes a housing with a gas injection chamber and two cylinders disposed therein; the gas injection chamber connected to a liquid reservoir disposed outside of the housing and a gas injection pipe; a first cylinder in communication with the gas injection chamber; a second cylinder connected to the liquid reservoir, and having a sliding vane groove and a compression chamber with a piston disposed therein in communication with the gas injection chamber; a sliding vane, received in the sliding vane groove when the gas injection chamber is in communication with the liquid reservoir, with an outer end and the sliding vane groove defining a back-pressure chamber in communication with the gas injection chamber; and with an inner end abutting against the piston when the gas injection chamber is in communication with the gas injection pipe.

16 Claims, 7 Drawing Sheets

(51) Int. Cl.

| | |
|---|---|
| ***F04C 28/06*** | (2006.01) |
| ***F04B 25/00*** | (2006.01) |
| ***F04C 18/356*** | (2006.01) |

(56) References Cited

U.S. PATENT DOCUMENTS

| | | | | |
|---|---|---|---|---|
| 7,563,085 | B2 | 7/2009 | Sakaniwa et al. | |
| 8,905,722 | B2 * | 12/2014 | Choi | F04C 23/001 417/410.3 |
| 2004/0009083 | A1 * | 1/2004 | Kim | F01C 21/0863 418/23 |
| 2007/0154329 | A1 * | 7/2007 | Onoda | F01C 21/0863 417/216 |

FOREIGN PATENT DOCUMENTS

| | | | |
|---|---|---|---|
| CN | 202707496 | U | 1/2013 |
| CN | 203285687 | U | 11/2013 |
| CN | 203756524 | U | 8/2014 |
| JP | S60261 | A | 1/1985 |
| JP | 2006207559 | A | 8/2006 |
| JP | 2008286037 | | 11/2008 |
| JP | 2013001268 | A | 1/2013 |
| WO | 2009131088 | A1 | 10/2009 |

OTHER PUBLICATIONS

International Searching Authority, Written Opinion of the International Searching Authority for PCT/CN2014/072803 dated Dec. 9, 2014.

* cited by examiner

TWO-STAGE ROTARY COMPRESSOR AND REFRIGERATION CYCLE DEVICE HAVING SAME

CROSS-REFERENCE TO RELATED APPLICATION

The present application is a national phase entry under 35 USC § 371 of International Application PCT/CN2014/072803, filed Mar. 3, 2014, the entire disclosure of which is incorporated herein by reference.

FIELD

The present disclosure relates to a field of electric appliances, and more particularly to a two-stage rotary compressor and a refrigeration cycle device having the same.

BACKGROUND

The related technologies indicate that when a refrigeration cycle device, like an air conditioner, is operating under a large load, such as heating under an ultra-low temperature, a gas suction mass flow rate of a compressor is decreased due to a large specific volume of a refrigerant, which causes a sharp decrease in heating capacity of the compressor, and meanwhile makes oil return difficult; the heat taken away by the refrigerant is reduced, which may easily cause abrasion of a compressor pump body, a decline of reliability of an electric motor, and a low system energy efficiency.

SUMMARY

The present inventor is intended to solve one of the technical problems in the related art to at least some extent. Therefore, one object of the present inventor is to provide a two-stage rotary compressor with improved performance under various environment temperatures and high reliability.

Another object of the present inventor is to provide a refrigeration cycle device having the above-identified two-stage rotary compressor.

According to embodiments of a first aspect of the present invention, the two-stage rotary compressor includes: a gas injection pipe; a housing provided with a liquid reservoir outside the housing and a gas injection chamber within the housing, the gas injection chamber being connected to the liquid reservoir and the gas injection pipe; two cylinders disposed within the housing and spaced apart from each other, a first cylinder of the two cylinders being communicated with the gas injection chamber, a second cylinder thereof being communicated with the liquid reservoir and having a sliding vane groove extending in a radial direction and a compression chamber, and an exhaust hole of the compression chamber being in communication with the gas injection chamber; a piston disposed within the gas injection chamber and capable of rolling along an inner wall of the gas injection chamber; and a sliding vane movably disposed inside the sliding vane groove and having an outer end together with an inner wall of the sliding vane groove defining a backpressure chamber communicated with the gas injection chamber, wherein the sliding vane is configured to be received in the sliding vane groove when the gas injection chamber is in communication with the liquid reservoir, and an inner end of the sliding vane abuts against the piston when the gas injection chamber is in communication with the gas injection pipe.

The two-stage rotary compressor according to embodiments of the present invention, when the refrigeration cycle device like an air conditioner is operating under a large load such as heating under an ultra-low temperature, the adoption of two-stage gas injection compression may efficiently increase a gas mass flow rate, improve heating capacity and energy efficiency of the refrigeration cycle device, and improve pump body lubrication; for refrigeration under an ordinary temperature work condition, the adoption of single-stage compression may improve the efficiency and energy efficiency of the refrigeration cycle device.

In addition, the two-stage rotary compressor according to the embodiments of the present invention may also have the additional technical features as followed:

Optionally, a bottom of a lower one of the two cylinders is provided with a bearing; a bottom of the bearing is provided with a cover plate; the cover plate and the bearing together define the gas injection chamber.

Optionally, an isolating device is provided between the two cylinders, and defines the gas injection chamber therein.

Specifically, the isolating device includes an isolating body having an open top and/or an open bottom; and an isolating plate disposed to the top and/or the bottom of the isolating body, and defining the gas injection chamber together with the isolating body.

Optionally, the gas injection chamber is connected with the liquid reservoir and the gas injection pipe via a three-way valve.

Further, the gas injection chamber has a gas suction hole connected to the three-way valve, and the backpressure chamber is in communication with the gas suction hole.

Optionally, an exhaust volume of the first cylinder is V1 and an exhaust volume of the second cylinder is V2, wherein V1/V2=0.45~0.95.

Optionally, a height of the first cylinder is smaller than a height of the second cylinder; a crankshaft is provided in the housing and provided with two eccentric portions spaced apart from each other along an axial direction, and a lower end of the crankshaft extends into the two cylinders; and the two eccentric portions are respectively located in the two cylinders, eccentric amount of the eccentric portion within the first cylinder being larger than eccentric amount of the eccentric portion within the second cylinder.

According to a second aspect of the present invention, the refrigeration cycle device includes a evaporator; a condenser connected to the evaporator; a throttling device disposed between the evaporator and the condenser; a flash evaporator disposed between the throttling device and the condenser; and a two-stage rotary compressor according to the first aspect of the present invention, which has a gas return port and a gas outlet; the evaporator and the condenser are in communication with the gas return port and the gas outlet respectively via a four-way valve, and the evaporator is connected to the gas injection pipe.

The refrigeration cycle device according to embodiments of the present invention, by setting the two-stage rotary compressor according to the embodiments of the first aspect, may choose the single-stage operation under a small load and adopt the two-stage operation under a large load, so that the overall performance, the reliability and the energy efficiency of the refrigeration cycle device are effectively improved.

Further, a control valve is provided between the condenser and the flash evaporator; and a bypass valve is connected to the control valve and the flash evaporator in parallel.

More further, refrigeration cycle device also includes a first throttling device disposed between the control valve and the flash evaporator and a first control valve disposed between the flash evaporator and the throttling device; and the control valve, the first throttling device and the flash evaporator are connected to the bypass valve in parallel.

Optionally, the throttling device is a capillary tube or an expansion valve.

Further, a second control valve is provided between the gas return port and the gas injection pipe.

Optionally, the refrigeration cycle device is an air conditioner.

Further, the refrigeration cycle device further includes a water tank connected to the evaporator to exchange heat with the evaporator.

Optionally, the refrigeration cycle device is a heat-pump water heater.

REFERENCE NUMERALS

Figure 1:
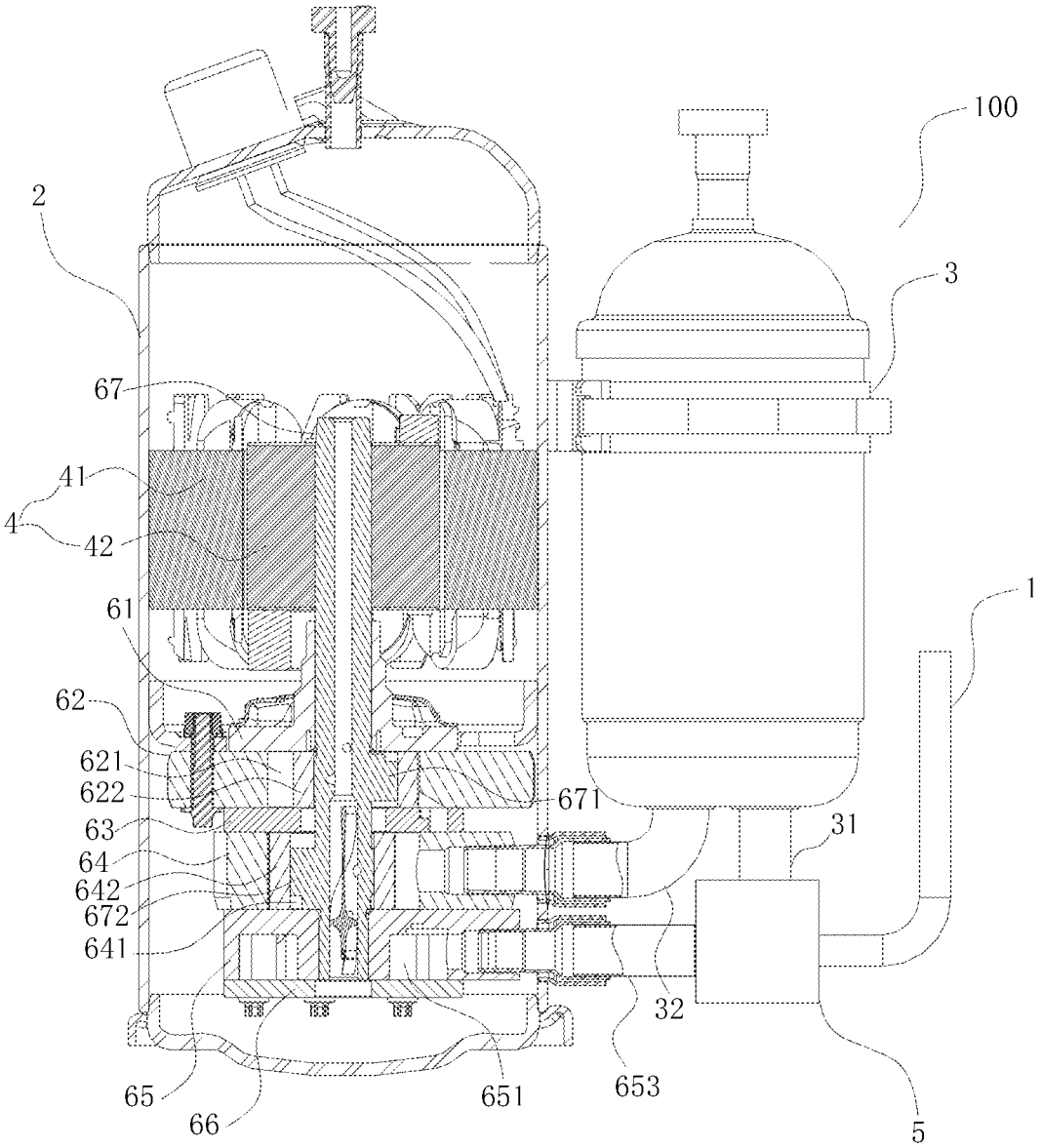
FIG. 1 shows a schematic view of a two-stage rotary compressor according to an embodiment of the present invention.

100: two-stage rotary compressor;

1: gas injection pipe; 2: housing; 21: gas outlet;

3: liquid reservoir; 31: low-pressure gas suction pipe; 32: first gas suction pipe; 33: gas return port;

4: electric motor; 41: stator; 42: rotator; 5: three-way valve

6: compression device;

61: main bearing; 62: first cylinder; 621: first compression chamber;

622: first piston; 623: first sliding vane; 624: spring;

63: partition plate; 631 isolating body; 632: isolating plate;

64: second cylinder; 641: second compression chamber; 642: second piston;

643: second sliding vane; 644: backpressure chamber;

65: auxiliary bearing; 651: gas injection chamber; 652: gas suction hole; 653: second gas suction pipe;

6541: first channel; 6542: second channel; 6543: third channel;

66: cover plate; 67: crankshaft; 671: first eccentric portion 672: second eccentric portion;

200: refrigeration cycle device;

201: evaporator; 202: condenser; 203: a throttling device;

204: flash evaporator; 2041: second control valve;

205: bypass valve; 206: four-way valve; 207: control valve;

208: first throttling device; 209: first control valve.

DETAILED DESCRIPTION

Embodiments of the present invention will be described in detail and examples of the embodiments will be illustrated in the drawings, in which same or similar reference numerals are used to indicate same or similar members or members with same or similar functions throughout the specification. The embodiments described herein with reference to drawings are explanatory, which are used to illustrate the present invention, but shall not be construed to limit the present invention.

A two-stage rotary compressor 100 according to embodiments of a first aspect of the present invention may be used in a refrigeration cycle device like an air conditioner. In the following description of the present application, the two-stage rotary compressor 100 used in the air conditioner is exemplified. Of course, it should be understood by those in the art that the two-stage rotary compressor 100 according to the present inventor may also be used in a heat-pump water heater.

As shown in FIG. 1 to FIG. 4, the two-stage rotary compressor 100 according to embodiments of the first aspect of the present invention includes a gas injection pipe 1, a housing 2, two cylinders, a piston and a sliding vane.

A liquid reservoir 3 is disposed outside the housing 2, and a gas injection chamber 651 is disposed within the housing 2. In an example of FIG. 1, the liquid reservoir 3 may be fixed to a side wall of the housing 2; an accommodating chamber is defined in the housing 2; an electric motor 4 is provided in an upper portion of the accommodating chamber; the electric motor 4 includes an annular stator 41 fixed on an inner wall of the housing 2 and a rotator 42 pivotally disposed in the stator 41; a lower portion of the accommodating chamber is provided with a compression device 6; the electric motor 4 actuates the compression device 6 to compress gas; the gas injection chamber 651 is defined in the compression device 6 and connected to the liquid reservoir 3 and the gas injection pipe 1, so as to inject gas with different pressures into the gas injection chamber 651 respectively.

The compression device 6 includes two cylinders, two pistons, two sliding vans, two bearings, a partition plate 63 and a crankshaft 67. To be convenient for description, two cylinders, two pistons, two sliding vanes, two bearings are distinguished as a first cylinder 62 and a second cylinder 64, a first piston 622 and a second piston 642, a first sliding vane 623 and a second sliding vane 643, and a main bearing 61 and an auxiliary bearing 65 respectively.

The first cylinder 62 and the second cylinder 64 are configured as a cylindrical shape with an open top and an open bottom; the first cylinder 62 and the second cylinder 64 are spaced apart from each other in a up-and-down direction and the first cylinder 62 is located above the second cylinder 64; the first cylinder 62 and the second cylinder 64 are respectively formed with a first sliding vane groove and a second sliding vane groove extending in a radial direction, and the first sliding vane 623 and the second vane 643 are received in the first sliding vane groove and the second sliding vane groove respectively and movable in an inward and outward direction; an outer end of the first sliding vane 623 is connected with a spring, and an inner end of the first sliding vane 623 always keeps in contact with an outer circumferential wall of the first piston 622 under an elastic force of the spring; the partition plate 63 is disposed between the first cylinder 62 and the second cylinder 64, the main bearing 61 is disposed on the top of the first cylinder 62, and the auxiliary bearing 65 is disposed on the bottom of the second cylinder 64, such that the main bearing 61, the first cylinder 62 and the partition plate 63 together define the first compression chamber 621 while the partition plate 63, the second cylinder 64 and the auxiliary bearing 65 together define the second compression chamber 641; an upper end of the crankshaft 67 is connected to the rotator 42 of the electric motor 4 and driven to rotate by the rotator 42; a lower end of the crankshaft 67 successively passes through the main bearing 61 and the partition plate 63, and extends into the first compression chamber 621 and the second compression chamber 641; a first eccentric portion 671 and a second eccentric portion 672 are provided on the crankshaft 67, and spaced apart from each other along an axial direction of the crankshaft 67; the first piston 622 and the second piston 642 are respectively fitted over the first eccentric portion 671 and the second eccentric portion 672, and are capable of rolling along inner walls of the first compression chamber 621 and the second compression chamber 641. Here, it should be noted that the "inward" direction may be construed as a direction towards a center of the first cylinder 62 or the second cylinder 64, and an opposite direction thereof is defined as the "outward" direction, i.e. a direction away from the center of the first cylinder 62 or the second cylinder 64.

Two cylinders (i.e. the first cylinder 62 and the second cylinder 64) are both disposed within the housing 2 and spaced apart from each other in a vertical direction (for example, the up-and-down direction in FIG. 1); one of the two cylinders (for example, the first cylinder 62 in FIG. 1) is in communication with the gas injection chamber 651; specifically, the gas injection chamber 651 is in communication with a gas suction hole of the first compression chamber 621 of the first cylinder 62, so that the gas within the gas injection chamber 651 is introduced into the first compression chamber 621 to be compressed.

The other one of the two cylinders (for example, the second cylinder 62 in FIG. 1) is in communication with the liquid reservoir 3; specifically, the second compression chamber 641 of the second cylinder 64 is in communication with a bottom of the liquid reservoir 3 via the first gas suction pipe 32 to introduce the gas to be compressed into the second compression chamber 641 to undergo the compression; and the other cylinder described above (for example, the second cylinder 64 in FIG. 1) has a sliding vane groove (i.e. the second sliding vane groove) extending in the radial direction and a compression chamber (i.e. the second compression chamber 641); an exhaust hole of the compression chamber (i.e. the second compression chamber 641) is in communication with the gas injection chamber 651; a piston (i.e. the second piston 642) is disposed in the compression chamber (i.e. the second compression chamber 641) and capable of rolling along the inner wall of the compression chamber (i.e. the second compression chamber 641); when the second cylinder 64 is doing the compression work, the compressed gas within the second compression chamber 641 may enter the gas injection chamber 651 via the exhaust hole, and the gas injection chamber 651 introduces the gas therein into the first compression chamber 621 to be compressed again.

A sliding vane (for example, the second sliding vane 643 in FIGS. 1 and 4) is movably disposed in a sliding vane groove (i.e. the second sliding vane groove), and an outer end of the sliding vane (i.e. the second sliding vane 643) and an inner wall of the sliding vane groove (i.e. the second sliding vane groove) together define a backpressure chamber 644; the backpressure chamber 644 is in communication with the gas injection chamber 651, in which the sliding vane (i.e. the second sliding vane 643) is configured to be received in the sliding vane groove (i.e. the second sliding vane groove) when the gas injection chamber 651 is in communication with the liquid reservoir 3; for example, when the air conditioner is under a refrigerating work condition, the gases entering the gas injection chamber 651 and the second cylinder 64 both are low-pressure gases, pressures of the inner and outer ends of the second sliding vane are equal, that is, pressures in the second compression chamber 641 and the backpressure chamber 644 are equal, and the inner end of the second sliding vane 643 does not abut against the second piston 642. Therefore, the second cylinder 64 is unloaded, and the first cylinder 62 sucks the low-pressure gas from the gas injection chamber 651. In such a way, the single-stage compression is performed.

When the gas injection chamber 651 is in communication with the gas injection pipe 1, the inner end of the second sliding vane 643 abuts against the piston (i.e. the second piston 642). For example, when the air conditioner is under a low-temperature work condition, the second cylinder sucks a low-pressure gas from an outlet of an evaporator 201 of the air conditioner, and the gas injection chamber 651 sucks a medium-pressure from a flash evaporator 204 of the air conditioner, in which case the pressures of the inner and the outer ends of the second sliding vane are unequal. That is, it is the low-pressure gas with lower pressure in the second compression chamber 641 while it is the medium-pressure gas with higher pressure in the backpressure chamber 644. The second sliding vane 643 abuts against the second piston 642 under the action of the pressure difference, and the second cylinder 64 is loaded; after being compressed by the second cylinder 64, the gas in the gas injection chamber 651 becomes a mixture gas of the gas compressed by the second cylinder 64 and the medium-gas from the flash evaporator 204; the first cylinder 62 sucks the medium-pressure gas and then performs the second compression; after being compressed to a high pressure, the gas is exhausted to an accommodation space of the housing 2. In such a way, the two-stage compression is achieved.

Thereby, the second sliding vane 643 is controlled by the gas pressure of the gas injection chamber 651. When operating in a single-stage mode, the gas pressure of the gas injection 651 is low, and is equal to the pressure of the second cylinder 64. That is, the second sliding vane 643 is decompressed and does not act, so as to decrease the abrasion of the two-stage rotary compressor 100 and improve the energy efficiency of the two-stage rotary compressor 100. When operating in a two-stage mode, the gas pressure in the gas injection 651 is medium, so the gas pressure of the backpressure chamber 644 is medium; compared with the high pressure in the housing 2 and outside the compression device 6, the pressure difference of the inner and the outer ends of the second sliding vane 643 is decreased, thus reducing the abrasion of the second sliding vane 643, and protecting the second sliding vane 643 efficiently; further, the abrasion of the two-stage rotary compressor 100 is reduced and the service life of the two-stage rotary compressor 100 is improved.

The two-stage rotary compressor 100 according to embodiments of the present invention, when a refrigeration cycle device 200, like an air conditioner, is operating under a large load, such as heating under an ultra-low temperature, the adoption of the two-stage gas injection compression may efficiently increase the gas mass flow rate, improve the heating capacity and energy efficiency of the refrigeration cycle device 200, and improve the pump body lubrication; for refrigeration under an ordinary temperature work condition, the adoption of the single-stage compression may improve the efficiency and energy efficiency of the refrigeration cycle device 200.

Figure 2:
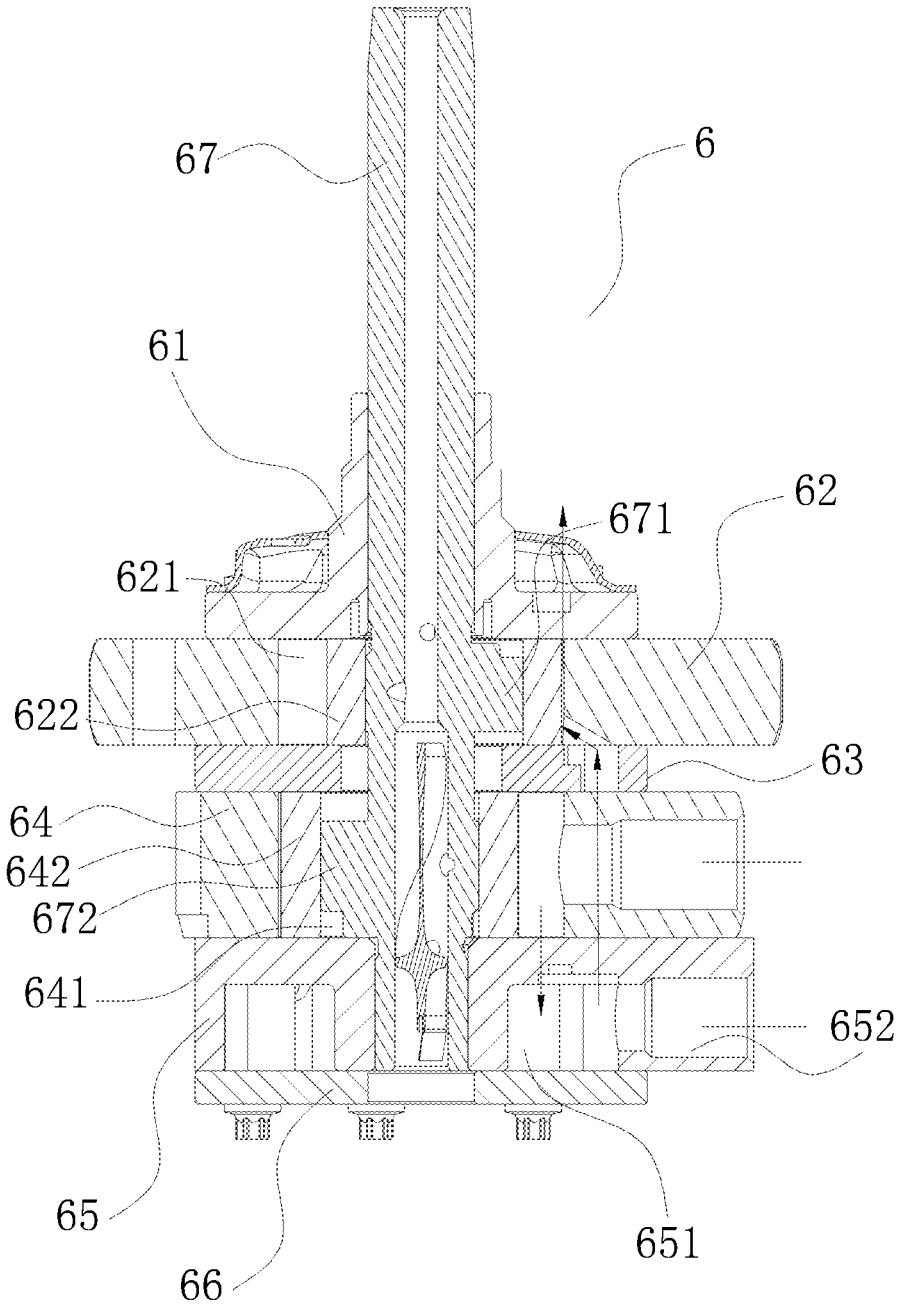
FIG. 2 shows a schematic view of a compression device of the two-stage rotary compressor in FIG. 1
Figure 3:
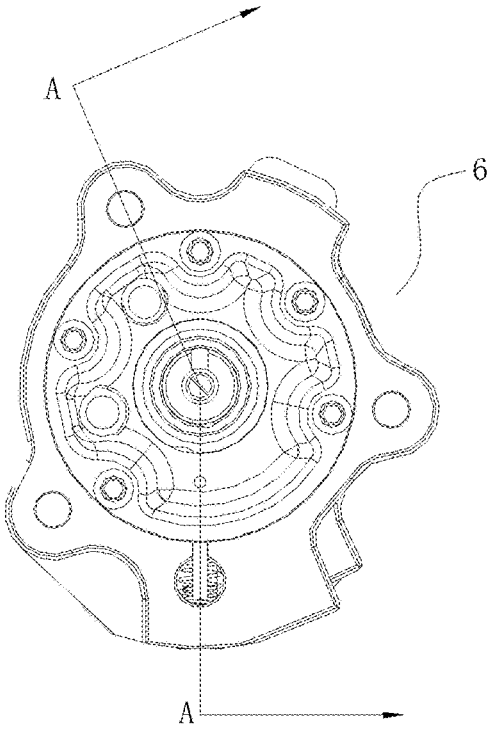
FIG. 3 shows a top view of the compression device in FIG. 2.
Figure 4:
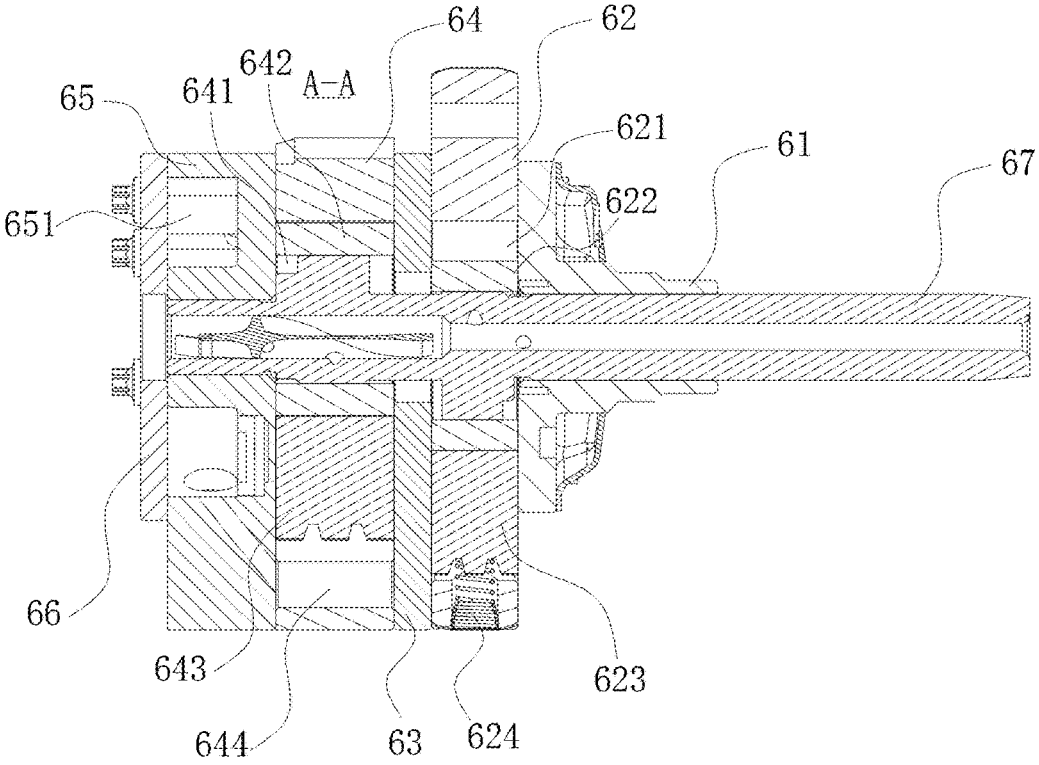
FIG. 4 shows a sectional view taken along line A-A in FIG. 3.

In an embodiment of the present invention, as shown in FIGS. 1 and 2, a bottom of a lower one of the two cylinders (for example, the second cylinder 64 in FIGS. 1 and 2) is provided with a bearing (for example, the auxiliary bearing 65 in FIGS. 1 and 2), a bottom of the bearing (i.e. the auxiliary bearing 65) is provided with a cover plate 66, and the cover plate 66 and the bearing (i.e. the auxiliary bearing 65) together define the gas injection chamber 651. Thereby, this has the advantages of easy installation, high assembling efficiency and low cost.

Figure 7:
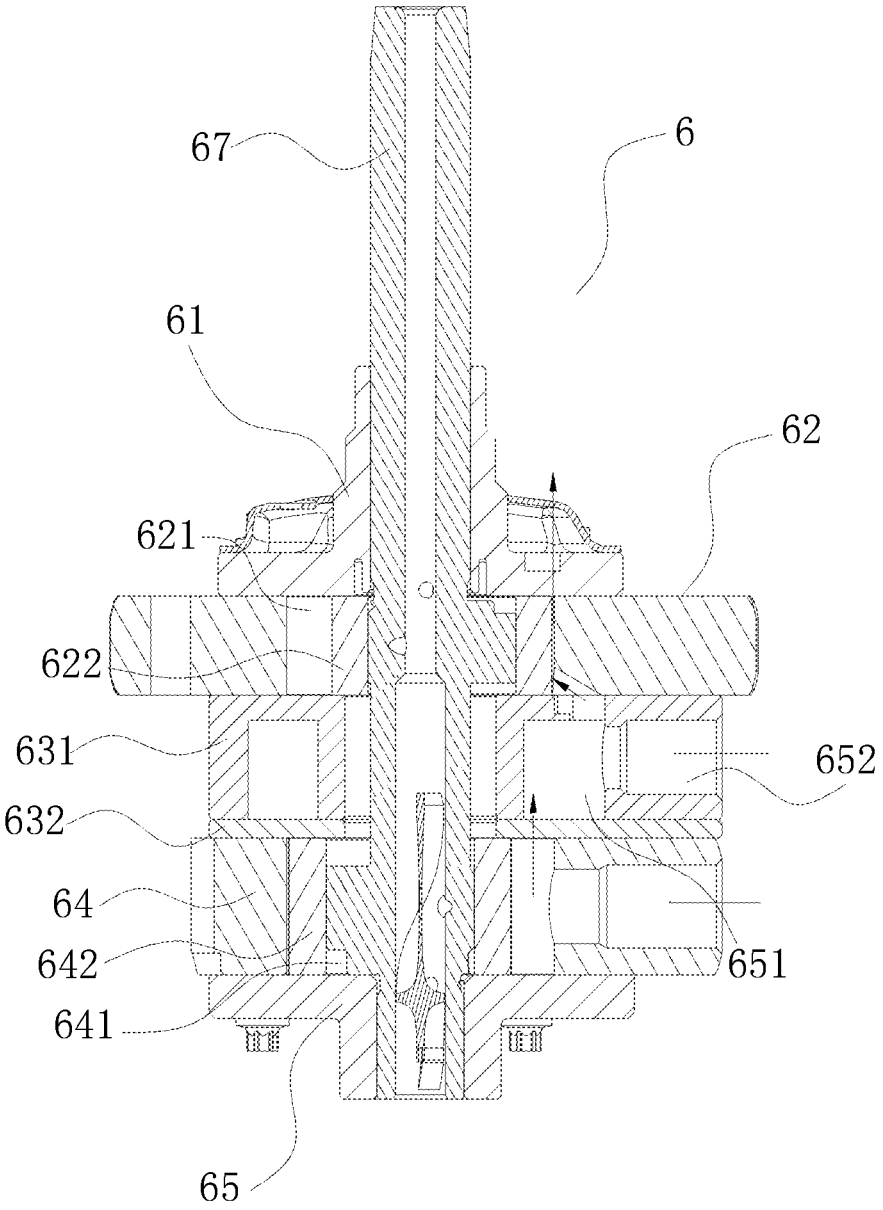
FIG. 7 shows a schematic view of a compression device according to another embodiment of the present invention

Of course, the present invention is not limited thereto, and in other embodiments of the present invention, referring to FIG. 7, an isolating device is provided between the two cylinders, and defines the gas injection chamber 651. Specifically, the isolating device includes: an isolating body 631 and an isolating plate 632; a top and/or a bottom of the isolating body 631 is open; the isolating plate 632 is disposed to the top and/or the bottom of the isolating body 631 and defines the gas injection chamber 651 together with the isolating plate 632.

In an example of FIG. 7, the isolating device isolates the first cylinder 62 from the second cylinder 64, and includes one isolating body 631 and one isolating plate 632. The bottom of the isolating body 631 is open; the isolating plate 632 is disposed to the bottom of the isolating body 631 and defines the gas injection chamber 651 together with the isolating body 631, in which case an upper surface of the isolating body 631 is in contact with a lower surface of the first cylinder 62, and a lower surface of the isolating plate 632 is in contact with an upper surface of the second cylinder 64. Of course, in another example of the present invention, the isolating plate 632 may also be disposed to the top of the isolating body 631 to define the gas injection chamber 651 together with the isolating body 631, in which the top of the isolating body 631 is open (not illustrated). In some other examples of the present invention, the top and the bottom of the isolating body 631 are open, and may respectively be provided with one isolating plate 632, the two isolating plates 632 and the isolating body 631 together defining the gas injection chamber 651 (not illustrated).

In an embodiment of the present invention, the gas injection chamber 651 is connected to the liquid reservoir 3 and the gas injection pipe 1 via a three-way valve 5, as shown in FIG. 1, the second gas suction pipe 653 is provided outside the housing 2 and is always in communication with the gas injection chamber 651, and the second gas suction pipe 653 is connected to a low-pressure gas suction pipe 31 and the gas injection pipe 1 at the bottom of the liquid reservoir 3 via the three-way valve 5. When the air conditioner is refrigerating, the three-way valve 5 controls the second gas suction pipe 653 to be in communication with the low-pressure gas suction pipe 31; when the air conditioner is heating, the three-way valve 5 controls the second gas suction pipe 653 to be in communication with the gas injection pipe 1. Thereby, the three-way valve 5 is provided to automatically switch the refrigerant flowing into the gas injection chamber 651 to come from the flash evaporator 204 or come from the evaporator 201 according to work conditions; when the air conditioner is operating under a low load, the three-way valve 5 controls the gas injection chamber 651 to suck the refrigerant from the evaporator 201, so as to make the second cylinder 64 of the two-stage rotary compressor 100 unload and the first cylinder 62 thereof compress the gas; when the air conditioner is operating under the heating condition, the three-way valve 5 controls the gas injection chamber 651 to suck the refrigerant from the flash evaporator 204 so as to make the two-stage rotary compressor 100 operate in the two-stage mode.

Figure 5:
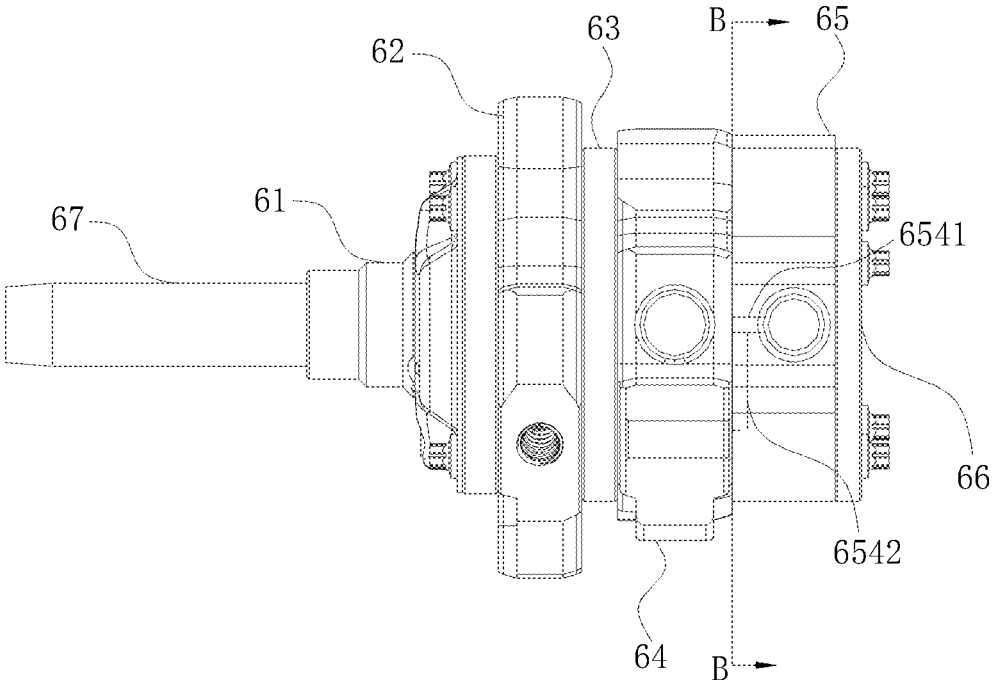
FIG. 5 shows a side view of the compression device in FIG. 1.
Figure 6:
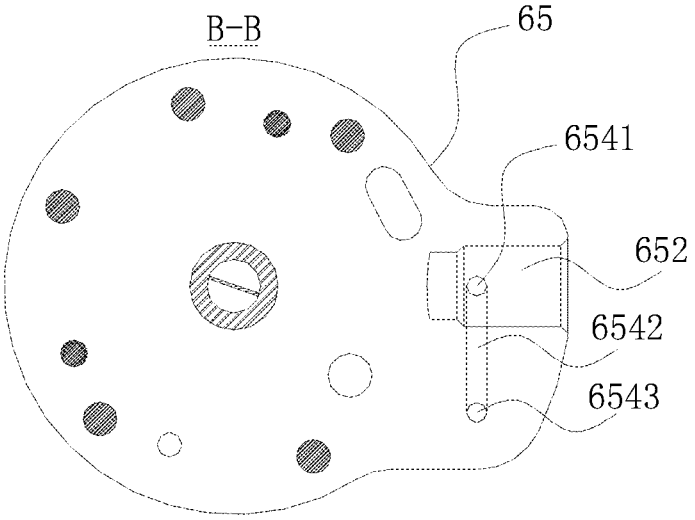
FIG. 6 shows a sectional view taken along line B-B in FIG. 5.

Further, the gas injection chamber 651 has a gas suction hole 652 connected to the three-way valve 5, and the backpressure chamber 644 is in communication with the gas suction hole 652. Referring to FIGS. 5 and 6, the gas suction hole 652 corresponds to the second gas suction pipe 653, an end of the second gas suction pipe 653 extends into the gas suction hole 652 and is in communication with an interior of the gas injection chamber 651, and the backpressure chamber 644 is in communication with the gas suction hole 652 via an airflow channel as shown in FIGS. 5 and 6. Specifically, the airflow channel includes a first channel 6541, a second channel 6542 and a third channel 6543; the first channel 6541extends in a vertical direction, and a lower end of the first channel 6541 is in communication with the gas suction hole 652; the second channel 6542 extends in a horizontal direction, and a first end of the second channel 6542 is communication with an upper end of the first channel 6541; optionally, the second channel 6542 is formed by recessing an upper end surface of the auxiliary bearing 65 downward; the third channel 6543 extends in the vertical direction, and a lower end of the third channel 6543 is in communication with a second end of the second channel 6542 while an upper end of the third channel 6543 is in communication with the backpressure chamber 644; since the gas suction of the first cylinder 62 may result in a pressure fluctuation in the gas injection chamber 651 and an insufficient backpressure of the second sliding vane 643 during the two-stage compression, it is favorable to stabilizing the backpressure of the second sliding vane 643 and ensure the action of the second sliding vane 643 by providing the backpressure chamber 644 in direct communication with the gas suction hole 652.

Optionally, an exhaust volume of one cylinder (for example, the first cylinder 62 in FIG. 1) of the two cylinders is V1, and an exhaust volume of the other cylinder (for example, the second cylinder 64 in FIG. 1) is V2, in which, V1/V2=0.45~0.95. It should be noted herein that the "exhaust volume" may be construed as the volume of the compressed gas exhausted from the exhaust hole of the first cylinder 62 or the second cylinder 64. For different regions and use conditions, the difference of the ratio of V1 and V2 will result in different energy efficiencies; when a temperature difference of evaporation and condensation is big (e.g. under a heating pump work condition), V1/V2 may take a smaller value; when the temperature difference of evaporation and condensation is smaller, V1/V2 may take a larger value; thus for different regions and use conditions, the energy efficiency of the two-stage rotary compressor 100 may be improved.

Optionally, a height of the one cylinder (for example, the first cylinder 62 in FIG. 1) is smaller than a height of the other cylinder (for example, the second cylinder 64 in FIG.

1); a crankshaft 67 is provided in the housing 2; two eccentric portions (i.e. the first eccentric portion 671 and the second eccentric portion 672) are provided on the crankshaft 67, and spaced apart from each other along the axial direction of the crankshaft 67; the lower end of the crankshaft 67 extends into the two cylinders, and the two eccentric portions are respectively located in the two cylinders (i.e. the first cylinder 62 and the second cylinder 64); the eccentric amount of the eccentric portion within the one cylinder (for example, the first cylinder 62 in FIG. 1) is larger than the eccentric amount of the eccentric portion within the other cylinder (for example, the second cylinder 64 in FIG. 1). The operating pressure scope of refrigerants R11, R410A used at present determines that the pressure difference of the low-pressure stage is small, and the pressure difference of the high-pressure stage is large; further flattening of the first cylinder 62 will improve the energy efficiency of the two-stage rotary compressor 100, and make the structure of the two-stage rotary compressor 100 more compact, which is favorable to improving reliability, in particular the reliability of bearings and shafts.

As shown in FIGS. 8 to 11, the refrigeration cycle device 200 according to embodiments of the second aspect of the present invention includes the evaporator 201, a condenser 202, a throttling device 203, the flash evaporator 204 and the two-stage rotary compressor 100 according to embodiments of the first aspect of the present invention described above.

The condenser 202 is connected to the evaporator 201. The throttling device 203 is disposed between the evaporator 201 and the condenser 202. The flash evaporator 204 is disposed between the throttling device 203 and the condenser 202. The two-stage rotary compressor 100 has a gas return port 33 and a gas outlet 21; the evaporator 201 and the condenser 202 are respectively in communication with the gas return port 33 and the gas outlet 21 via a four-way valve 206; the flash evaporator 204 is connected to the gas injection pipe 1. Further, a control valve 207 may be provided between the condenser 202 and the flash evaporator 204; the refrigeration cycle device 200 further includes a bypass valve 205 connected to the control valve 207 and the flash evaporator 204 in parallel. When the refrigeration cycle device 200, like the air conditioner, is operating under a low load, the bypass valve 205 makes the gas out of the condenser 202 not pass through the flash evaporator 204 and be bypassed to the throttling device 203. Optionally, as shown in FIG. 1 and FIGS. 8 to 11, the gas return port 33 is disposed in the top of the liquid reservoir 3, and the gas outlet 21 is disposed in the top of the housing 2.

Figure 8:
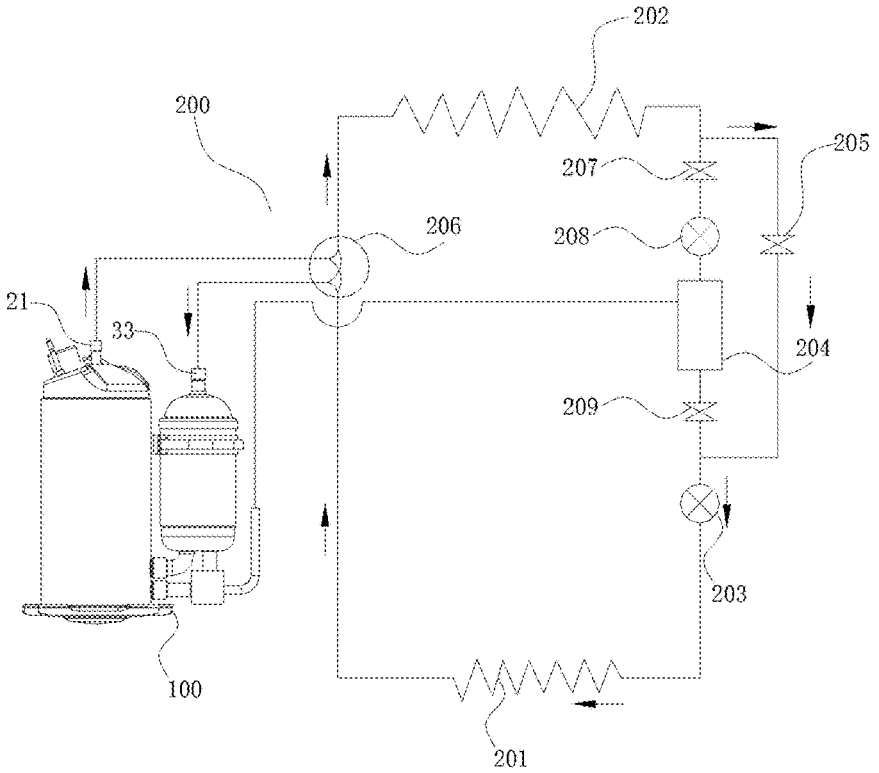
FIG. 8 shows a schematic view of a refrigeration cycle device according to an embodiment of the present invention when refrigerating.

When the refrigeration cycle device 200 is an air conditioner and when the air conditioner conducts the refrigeration, as shown in FIG. 8, the control valve 207 is closed and the bypass valve 205 is opened; the high-temperature and high-pressure refrigerant out of the gas outlet 21 of the housing 2 enters the condenser 202, the refrigerant of high temperature and high pressure becomes a liquid refrigerant after the condensation process of the condenser 202; the liquid refrigerant is depressurized by the throttling device 203 after passing through the bypass valve 205, and then becomes a low-pressure liquid refrigerant; the throttled refrigerant enters the evaporator 201, performs the evaporation and the heat exchange in the evaporator 201, and then becomes gaseous; the gaseous refrigerant enters the housing 2 via the gas return port 33.

Figure 9:
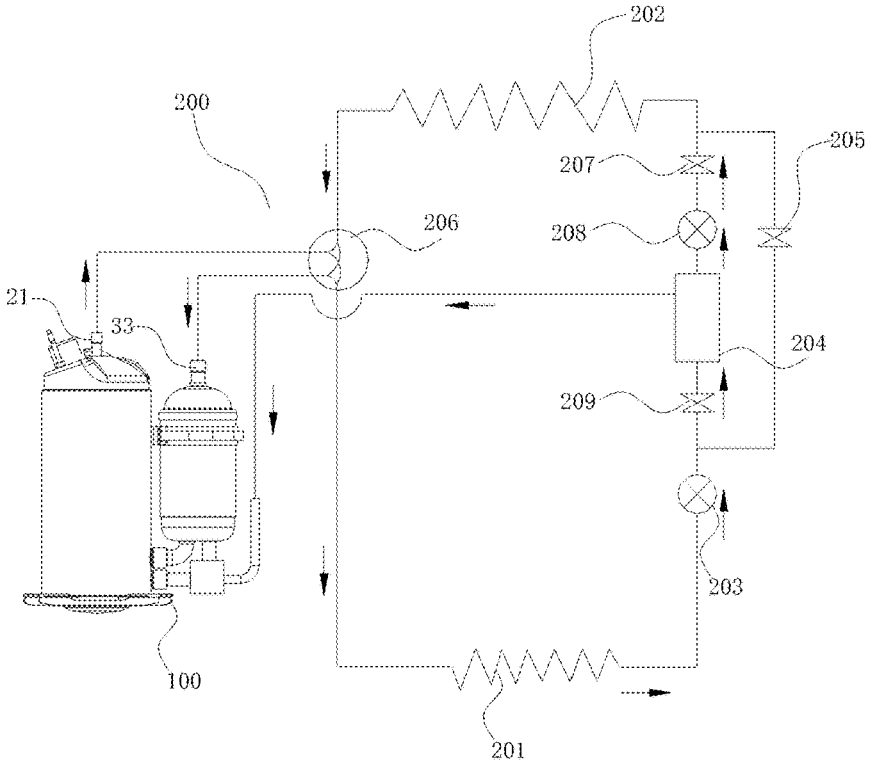
FIG. 9 shows a schematic view of the refrigeration cycle device in FIG. 8 when heating.

When the air conditioner conducts the heating, as shown in FIG. 9, the control valve 207 is opened and the bypass valve 205 is closed; the high-temperature and high-pressure refrigerant out of the exhaust hole of the housing 2 first enters the evaporation 201, and becomes a super-cooled high-pressure liquid refrigerant after the condensation process in the evaporator 201; the liquid refrigerant is depressurized by the throttling device 203 and then becomes a low-pressure liquid refrigerant; optionally, the throttling device 203 is a capillary tube or an expansion valve; the throttled refrigerant enters the flash evaporator 204 and performs gas-liquid separation; the gaseous refrigerant directly flows to the gas return port 33 while the pure liquid refrigerant enters the condenser 202; the refrigerant enters the housing 2 via the gas return port 33 after the evaporation process in the condenser 202.

The refrigeration cycle device 200 according to embodiments of the present invention, like an air conditioner, by setting the above-described two-stage rotary compressor 100 according to embodiments of the first aspect, may choose the single-stage operation under a small load and adopt the two-stage operation under a large load, so that the overall performance, the reliability and the energy efficiency of the refrigeration cycle device 200 may be improved effectively.

In an embodiment of the present invention, referring to FIGS. 8 to 11, the refrigeration cycle device 200 also includes: a first throttling device 208 and a first control valve 209; the first throttling device 208 is disposed between the control valve 207 and the flash evaporator 204, and the first control valve 209 is disposed between the flash evaporator 204 and the throttling device 203; the control valve 207, the first throttling device 208 and the flash evaporator 204 are connected to the bypass valve 205 in parallel.

As shown in FIG. 8, the control valve 207 and the first control valve 209 are closed (the first control valve may also not be closed), and the bypass valve 205 is opened; the high-pressure refrigerant compressed by the two-stage rotary compressor 100 flows to the condenser 202 via the four-way valve 206, and then flows to the throttling device 203 passing through the bypass valve 205; the throttled and expanded refrigerant passes through the evaporator 201, and flows back to the two-stage rotary compressor 100 after the heat absorption of the evaporator 201. In such a case, the three-way valve 5 controls the gas injection chamber 651 to be in communication with the low-pressure gas suction pipe 31; since the gas suction pressure of the second cylinder 64 is consistent with the gas suction pressure of the gas injection chamber 651, and the pressure introduced into the backpressure chamber is low pressure, the second sliding vane does not act. The first cylinder 62 sucks the low-pressure refrigerant to perform the compression, so as to achieve the single-stage compression. During a refrigeration cycle, the adoption of the circuit may reduce the pipes and elements which the refrigerant passes through, and the system flow resistance loss, to improve the system energy efficiency.

As shown in FIG. 9, the bypass valve 205 is closed, and the control valve 207 and the first control valve 209 are opened; the high-pressure refrigerant compressed by the two-stage rotary compressor 100 flows to the evaporator 201 via the four-way valve 206; the refrigerant out of the evaporator 201 flows into the flash evaporator 204 after being throttled and expanded by the throttling device 203; the gas-liquid two-phase refrigerant after flash evaporation in the flash evaporator 204 is divided into two circuits: the refrigerant liquid of the main circuit enters the condenser 202 after being throttled and expanded by the first throttling device 208, becomes a refrigerant gas after performing the heat exchange in the condenser 202, and then flows into the two-stage rotary compressor 100 to undergo the compression; the refrigerant gas of the auxiliary circuit out of the flash evaporator 204 enters a gas injection circuit, so as to flow into the he two-stage rotary compressor 100. In such a case, the three-way valve 5 controls the gas injection chamber 651 to be in communication with the gas injection pipe 1; the medium-pressure gas out of the flash evaporator 204 enters the gas injection chamber 651; the exhaust pressure of the second cylinder 64 is the medium gas pressure, and then the two-stage rotary compressor 100 performs the two-stage compression cycle.

In addition, the refrigeration cycle device 200 further includes: a water tank (not illustrated) connected to the evaporator 201 to exchange heat with the evaporator 201. Optionally, the refrigeration cycle device 200 is a heat-pump water heater. When the refrigeration cycle device 200 is the heat pump water heater, the evaporator 201 performs the heat exchange with the water tank, and the system cycle is consistent with the above-described refrigerating and heating processes. In the heating process, the pressure difference is relatively large, in particular under the low-temperature heating and the heat-pump work condition, the adoption of the two-stage compression cycle may effectively improve the system heating capacity and the energy efficiency.

Figure 10:
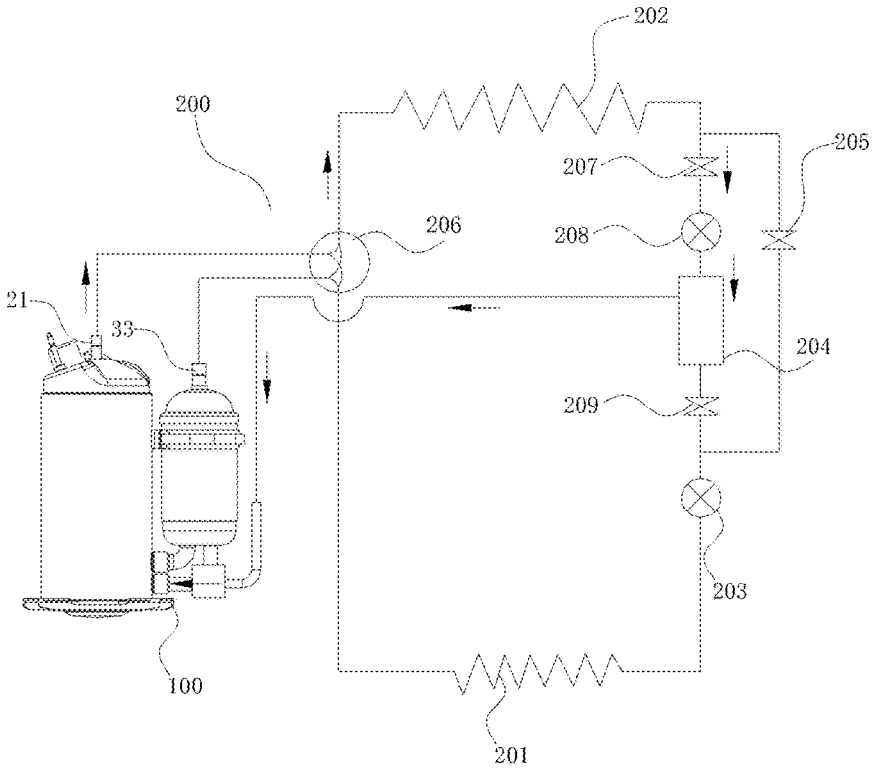
FIG. 10 shows a schematic view of the refrigeration cycle device in FIG. 8 when defrosting.
Figure 11:
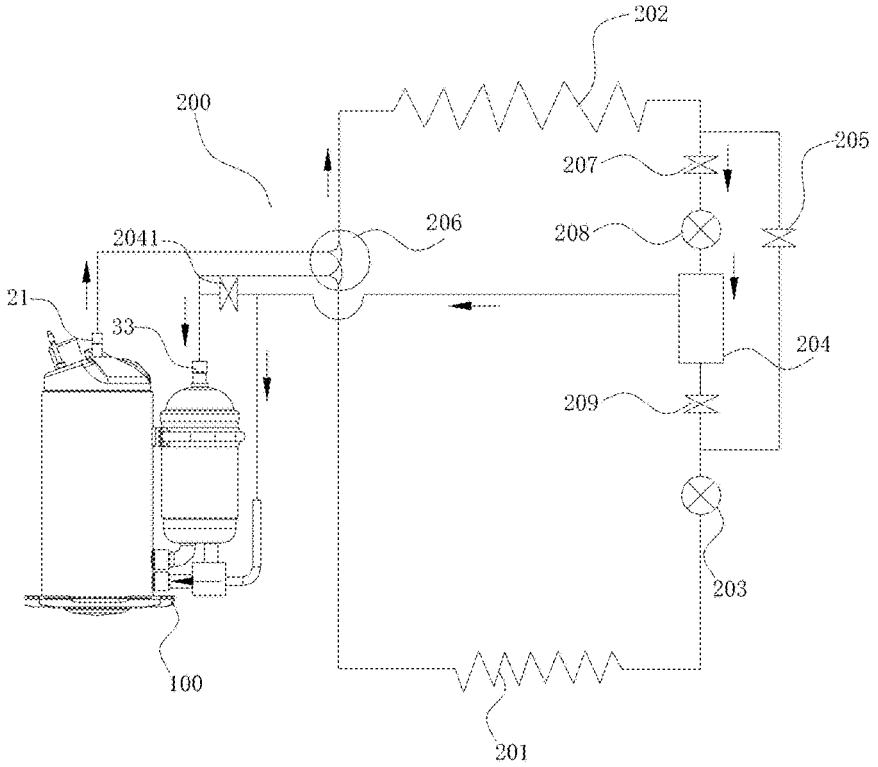
FIG. 11 shows a schematic view of a refrigeration cycle device according to another embodiment of the present invention when defrosting.

As shown in FIG. 10, in the defrosting process, the bypass valve 205 and the first control valve are closed, the high-pressure refrigerant compressed by the two-stage rotary compressor 100 flows to the condenser 202 via the four-way valve 206; the refrigerant out of the condenser 202 passes through the first throttling device 208, and the expanded low-pressure refrigerant flows into the flash evaporator 204; the refrigerant out of the flash evaporator 204 enters the two-stage rotary compressor 100 via a gas supplementation circuit. In such a case, the three-way valve 5 controls the gas injection chamber 651 to be in communication with the gas injection pipe 1.

Further, a second control valve 2041 is provided between the gas return port 33 and the gas injection pipe 1. Specifically, the gas injection pipe 1 is in communication with the low-pressure gas suction pipe 31, and the second control valve 2041 is provided between them; the second control valve 2041 is opened only under the defrosting mode, and closed under other modes; in the defrosting mode, the low-temperature refrigerant enters the gas injection chamber 651 and the second cylinder 64 of the two-stage rotary compressor 100 via the gas injection circuit, which may effectively prevent the second cylinder 64 from a situation of the gas suction negative pressure. In the defrosting mode, the pressure difference of the high pressure and the low pressure is small, and the pressure ratio thereof is small. If the two-stage compression is adopted, an excessive compression may occur easily, resulting in a rise in the power dissipation, but if adopting the circuit above-described is adopted, the situation may be avoided.

In the specification, it is to be understood that terms such as "central", "transverse", "length", "width", "thickness", "upper", "lower", "front", "rear", "vertical", "horizontal", "top", "bottom", "inner", "outer", "axial", "radial", and "circumferential" should be construed to refer to the orientation as then described or as shown in the drawings under discussion. These relative terms are for convenience and simplification of description of the present disclosure, and do not alone indicate or imply that the device or element referred to must have a particular orientation, and must be constructed or operated in a particular orientation, thus it should not be construed to a limit to the present disclosure.

In addition, terms such as "first", "second" and "three" are used herein for purposes of description and are not intended to indicate or imply relative importance or significance or to imply the number of indicated technical features. Thus, the feature defined with "first", "second" and "third" may comprise one or more of this feature. In the description of the present invention, "a plurality of" means two or more than two, unless specified otherwise.

In the present invention, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communications of two elements, which can be understood by those skilled in the art according to specific situations.

In the present invention, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween.

Reference throughout this specification to "an embodiment", "some embodiments", "an example", "a specific example", or "some examples" means that a particular feature, structure, material, or characteristic described in connection with the embodiment or example is included in at least one embodiment or example of the present disclosure. Thus, the appearances of the phrases in various places throughout this specification are not necessarily referring to the same embodiment or example of the present disclosure. Furthermore, the particular features, structures, materials, or characteristics may be combined in any suitable manner in one or more embodiments or examples. In addition, those skilled in the art may combine and compose the different embodiments or examples and features of the different embodiments or examples described in the specification without conflicting situation.

Although explanatory embodiments have been shown and described, it would be understood that the above embodiments are exemplary and cannot be construed to limit the present disclosure, and changes, alternatives, and modifications can be made in the embodiments without departing from the scope of the present disclosure by those skilled in the art.

What is claimed is:

1. A two-stage rotary compressor, comprising:

a gas injection pipe;

a housing provided with a liquid reservoir outside the housing and a gas injection chamber within the housing, the gas injection chamber being connected to the liquid reservoir and the gas injection pipe;

two cylinders disposed within the housing and spaced apart from each other, wherein a first cylinder of the two cylinders is communicated with the gas injection chamber, a second cylinder thereof is communicated with the liquid reservoir and has a sliding vane groove extending in a radial direction and a compression chamber, and an exhaust hole of the compression chamber is in communication with the gas injection chamber;

a piston disposed within the gas injection chamber and capable of rolling along an inner wall of the gas injection chamber; and a sliding vane movably disposed inside the sliding vane groove and having an outer end together with an inner wall of the sliding vane groove defining a backpressure chamber communicated with the gas injection chamber, wherein the sliding vane is configured to be received in the sliding vane groove when the gas injection chamber is in communication with the liquid reservoir, and an inner end of the sliding vane abuts against the piston when the gas injection chamber is in communication with the gas injection pipe.

2. The two-stage rotary compressor according to claim 1, wherein a bottom of a lower one of the two cylinders is provided with a bearing, a bottom of the bearing is provided with a cover plate, and the cover plate and the bearing together define the gas injection chamber.

3. The two-stage rotary compressor according to claim 1, wherein an isolating device is provided between the two cylinders, and defines the gas injection chamber therein.

4. The two-stage rotary compressor according to claim 3, wherein the isolating device includes:

an isolating body having an open top and/or an open bottom; and an isolating plate disposed to the top and/or the bottom of the isolating body, and defining the gas injection chamber together with the isolating body.

5. The two-stage rotary compressor according to any of claims 1-4, wherein the gas injection chamber is connected with the liquid reservoir and the gas injection pipe via a three-way valve.

6. The two-stage rotary compressor according to claim 5, wherein the gas injection chamber has a gas suction hole connected to the three-way valve, and the backpressure chamber is in communication with the gas suction hole.

7. The two-stage rotary compressor according to any of claims 1-6, wherein an exhaust volume of the first cylinder is V1, an exhaust volume of the second cylinder is V2, and V1/V2=0.45~0.95.

8. The two-stage rotary compressor according to any of claims 1-6, wherein a height of the first cylinder is smaller than a height of the second cylinder;

a crankshaft is provided in the housing and provided with two eccentric portions spaced apart from each other along an axial direction, and has a lower end extending into the two cylinders; and the two eccentric portions are respectively located in the two cylinders, eccentric amount of the eccentric portion within the first cylinder being larger than eccentric amount of the eccentric portion within the second cylinder.

9. A refrigeration cycle device, comprising:

an evaporator;

a condenser connected to the evaporator;

a throttling device disposed between the evaporator and the condenser;

a flash evaporator disposed between the throttling device and the condenser; and a two-stage rotary compressor according to any of claims 1-8, having a gas return port and a gas outlet;

wherein the evaporator and the condenser are in communication with the gas return port and the gas outlet respectively via a four-way valve, and the evaporator is connected to the gas injection pipe.

10. The refrigeration cycle device according to claim 9, wherein a control valve is provided between the condenser and the flash evaporator; and the refrigeration cycle device further comprises: a bypass valve connected to the control valve and the flash evaporator in parallel.

11. The refrigeration cycle device according to claim 10, further comprising:

a first throttling device disposed between the control valve and the flash evaporator and a first control valve disposed between the flash evaporator and the throttling device, wherein the control valve, the first throttling device and the flash evaporator are connected to the bypass valve in parallel.

12. The refrigeration cycle device according to any of claims 9-11, wherein the throttling device is a capillary tube or an expansion valve.

13. The refrigeration cycle device according to any of claims 9-12, wherein a second control valve is provided between the gas return port and the gas injection pipe.

14. The refrigeration cycle device according to any of claims 9-13, wherein the refrigeration cycle device is an air conditioner.

15. The refrigeration cycle device according to any of claims 9-13, further comprising:

a water tank connected to the evaporator to exchange heat with the evaporator.

16. The refrigeration cycle device according to claim 15, wherein the refrigeration cycle device is a heat-pump water heater.

* * * * *